US006763894B2

(12) United States Patent
Schoenrock et al.

(10) Patent No.: US 6,763,894 B2
(45) Date of Patent: Jul. 20, 2004

(54) CLEAN AGENT FIRE SUPPRESSION SYSTEM AND RAPID ATOMIZING NOZZLE IN THE SAME

(75) Inventors: John J. Schoenrock, Arlington, MA (US); Jonathan S. Meltzer, Brookline, MA (US); David Rausch, Leominster, MA (US); Joseph A. Senecal, Wellesley, MA (US)

(73) Assignee: Kidde-Fenwal, Inc., Ashland, MA (US)

( * ) Notice: Subject to any disclaimer, the term of this patent is extended or adjusted under 35 U.S.C. 154(b) by 307 days.

(21) Appl. No.: 09/920,360

(22) Filed: Aug. 1, 2001

(65) Prior Publication Data

US 2002/0027143 A1 Mar. 7, 2002

(51) Int. Cl.[7] ..... A62C 2/00

(52) U.S. Cl. ..... 169/47; 169/9; 169/11; 169/16; 169/37; 169/46; 169/85

(58) Field of Search ..... 169/9, 11, 16, 169/46, 47, 37, 71, 74, 85; 252/3, 4, 8

(56) References Cited

U.S. PATENT DOCUMENTS 4,436,160 A * 3/1984 Ragailler ..... 169/85
5,899,275 A * 5/1999 Okamoto et al. ..... 169/11
5,919,393 A * 7/1999 Flynn et al. ..... 252/8
6,016,874 A * 1/2000 Bennett ..... 169/85
6,112,822 A * 9/2000 Robin et al. ..... 169/46
6,346,203 B1 * 2/2002 Robin et al. ..... 169/46

OTHER PUBLICATIONS

Paper entitled *Atomisation Characteristics of Superheated Liquid Jets*, dated prior to Jul. 31, 2001 (11 pages).

Paper entitled *The Development of a Prototype Low–Level AFFF Nozzle Systems for U.S. Navy Aircraft Hangers*, dated Feb. 28, 2000 (70 pages).

* cited by examiner

*Primary Examiner*—Steven J. Ganey
(74) *Attorney, Agent, or Firm*—Merchant & Gould, P.C.

(57) ABSTRACT

An atomizing nozzle and fixed clean agent fire suppression system. The system stores gas fire suppressant in a liquefied state separate from propellant gas. Upon demand, the propellant charges the gas fire suppressant to provide a piston flow system that pushes the gas fire suppressant in the liquid state through a pipe network to the protected area of a building. The system includes a plurality of atomizing nozzles for atomizing the gas fire suppressant where it more easily vaporizes. Each atomizing nozzle comprises a nozzle body and a deflector body secured together in fixed relation. A conical flow passage is formed between the nozzle body and deflector body. The conical flow passage extends radially outward to a circumferential outlet slot that spreads the liquid clean agent out into a thin liquid conical fan that breaks up into droplets and atomizes quickly.

62 Claims, 6 Drawing Sheets

CLEAN AGENT FIRE SUPPRESSION SYSTEM AND RAPID ATOMIZING NOZZLE IN THE SAME

FIELD OF THE INVENTION

The present invention relates generally to fire suppression systems and nozzles, and more particularly relates to clean agent gaseous fire suppression systems that use a liquefied compressed gas fire suppressant for suppressing fires and nozzles for such systems.

BACKGROUND OF THE INVENTION

There are a wide variety of fire suppression systems commercially available today. One form of fire suppression system is known as a fixed "clean agent" gaseous fire suppression system. Clean agent fire extinguishing systems extinguish fires by creating a fire extinguishing atmosphere consisting of agent vapor or gas mixed with the air within the protected space. Clean agent systems are used in buildings and other such structures to suppress fires without water, powder or foam so not as to destroy or damage an enclosed area of the structure and/or equipment contained therein. Clean agent fire suppressants leave no residue upon evaporation. One common form of clean agent is a chemical that is in liquefied form under normal storage conditions but which may be vaporized to form a gaseous mixture with air which does not support combustion and extinguishes fires. Such liquefied-gas suppressants exists in liquid form when confined in a closed container but as a gas at ambient temperature and when not confined in a container.

Several years back, Halon 1301 (Bromotrifluoromethane) was the most common liquefied-gas fire suppressant used in fixed clean agent gaseous fire suppression systems. Halon 1301 quickly suppresses fires. Halon 1301 also has a very low boiling point (−57.8° C.) such that once compressed liquid Halon 1301 is released into a room, it expands very rapidly to a complete gaseous state. Halon 1301 has a normal boiling point of −57.8° C. (−72° F.) and a vapor pressure of 14.4 bar (209 psia) at 20° C. (68° F.). As normally used in fire extinguishing systems containers of Halon 1301 were superpressurized with nitrogen, to facilitate pipe transport, to a total pressure at 21° C. (70° F.) of 24.8 bar (360 psig) or more. However, since 1993, Halon 1301 has now generally been prohibited from production under the terms of the 1987 Montreal Protocol on Substances that Deplete the Ozone Layer. Due to the prohibition, the industry has had to look for viable alternative gas fire suppressants for the maintenance of existing systems and the design of new systems.

Today, the most widely used volatile liquefied-gas fire suppressant is 1,1,1,2,3,3,3-heptafluoropropane, or HFC-227ea. HFC-227ea has a normal boiling point of −16.4° C. (2.5° F.) and a vapor pressure of 3.9 bar (56.8 psia) at 20° C. (68° F.). This agent does not have the environmental problems associated with Halon 1301. In presently commercialized products, HFC-227ea agent is stored in steel cylinders with a substantial amount of dissolved compressed liquid nitrogen such that it is superpressurized to achieve a total pressure of either 360 psig or 600 psig. Upon the demand to suppress a fire, the solution of HFC-227ea and dissolved nitrogen is released into a pipe network and then discharged from a nozzle into the room of a building structure. The dissolved liquid nitrogen in the HFC-227ea plays an important role at this point. Namely, the dissolved liquid nitrogen expands rapidly upon being exposed to room pressure thereby breaking up the remaining HFC-227ea agent into tiny droplets that then boil to assume a gaseous state. This has occurred at a generally satisfactory rate for many systems but has also been subject to substandard results in some applications.

The substitution of this superpressurized HFC-227ea regime described above has certain limitations. In particular, the discharge of the suppresurized HFC-227ea agent from the steel cylinder into a network of pipes leading to the room of a building or other structure results in the agent and dissolved nitrogen being suddenly brought into a state of lower pressure. One result of this change is that some of the superpressurizing nitrogen gas, initially dissolved in the liquid HFC-227ea agent, comes out of solution and expands to a gaseous state in the pipe network. Clean agent and superpressurizing gas then flow through the pipe network as a two phase mixture. The two phase mixture consists of a liquid phase, with a reduced portion of the superpressurizing nitrogen gas still dissolved in the liquid agent, and a gas phase consisting of superpressurizing nitrogen gas with some agent vapor. One detrimental effect of the development of two-phase flow in a pipe system is that the mass flow rate of agent is limited as a consequence primarily due to the low average fluid density caused by the presence of low-density gas mixed with high-density liquid. Another inherent drawback is that HFC-227ea inherently has a higher boiling point than Halon 1301 and is subject to a slower vaporization. The dissolved nitrogen that expands rapidly upon discharge into the room has been useful but still has not achieved the superior vaporization characteristics previously experience for Halon 1301.

BRIEF SUMMARY OF THE INVENTION

It is the general objective according to one aspect of the present invention to improve the improve the vaporization in fixed clean agent fire suppression systems in light of the fact that Halon 1301 is no longer a desirable clean agent due to environmental prohibition.

It is the general objective according to another aspect of the present invention to improve the flow rates of gas fire suppressants through the pipe network of fixed clean agent fire suppression systems to achieve an effective fire suppression system without the need to rely on Halon 1301.

In accordance with these and other objectives, the present invention is directed toward a clean agent fire suppression system for a room or other enclosed structure that includes an agent tank containing a clean agent, namely, a volatile liquefied gas fire suppressant, and a propellant tank of a compressed gas or liquefied compressed gas propellant stored separate from the gas fire suppressant. The propellant is stored in series such that it is capable of charging the pressure of the gas fire suppressant on demand. The system includes a plurality of nozzles arranged in the structure in spaced relation and a pipe network connecting the gas fire suppressant to the nozzles. A on/off system valve or other suitable valve controls fluid flow through the pipe network to selectively allow or prevent flow of the gas fire suppressant pushed by the propellant through the pipe network to the nozzles.

In contrast to prior systems where propellant and agent are stored together, the disclosed system may be in the form of a piston flow system wherein the propellant pushes the gas fire suppressant through the pipe network with little dissolution or mixing of the agent such that a liquid flow is maintained through the pipes, thereby providing a high mass flow rate. The disclosed system utilizes atomizing nozzles to fan the liquid gas fire agent out into small droplets that vaporize quickly into a gaseous state. The system is suitable as a retrofit system for prior Halon 1301 systems and can use the same existing pipe network of Halon 1301 systems thereby achieving significant cost savings while at the same time meeting industry standards of delivering the clean agent to the protected space in a time interval not exceeding 10 seconds.

The present invention also is directed toward a rapid atomizing nozzle that vaporizes the liquid clean agent quickly upon discharge. The nozzle comprises a nozzle body and a deflector body secured together in fixed relation. The nozzle body includes an inlet port through the nozzle body along an axis and a conical flow surface extending radially outwardly from the inlet port. The deflector body includes a conical deflector surface in spaced fixed relation to the conical flow surface such that a conical flow passage is formed between the nozzle body and deflector body. The conical flow passage extends radially outward to a circumferential outlet slot that spreads the liquid clean agent out into a thin liquid conical fan that breaks up into small droplets that atomize more quickly. The atomizing nozzle is also beneficial for existing superpressurized clean agent fire suppression systems where the fire suppression gas is stored in a cylinder with dissolved compressed nitrogen.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
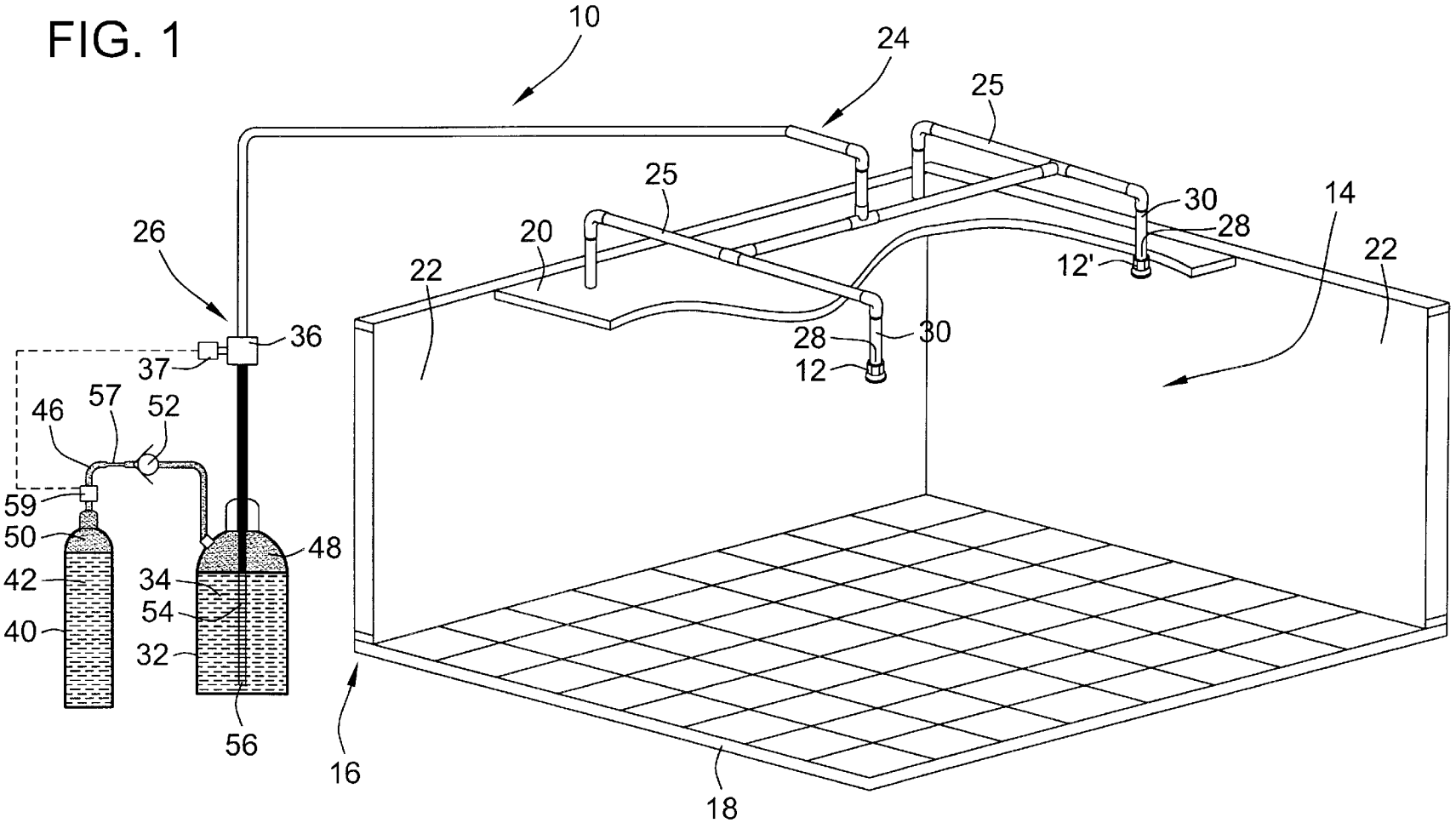
FIG. 1 is a partly schematic illustration of a clean agent fire suppression system according to a preferred embodiment of the present invention.
Figure 2:
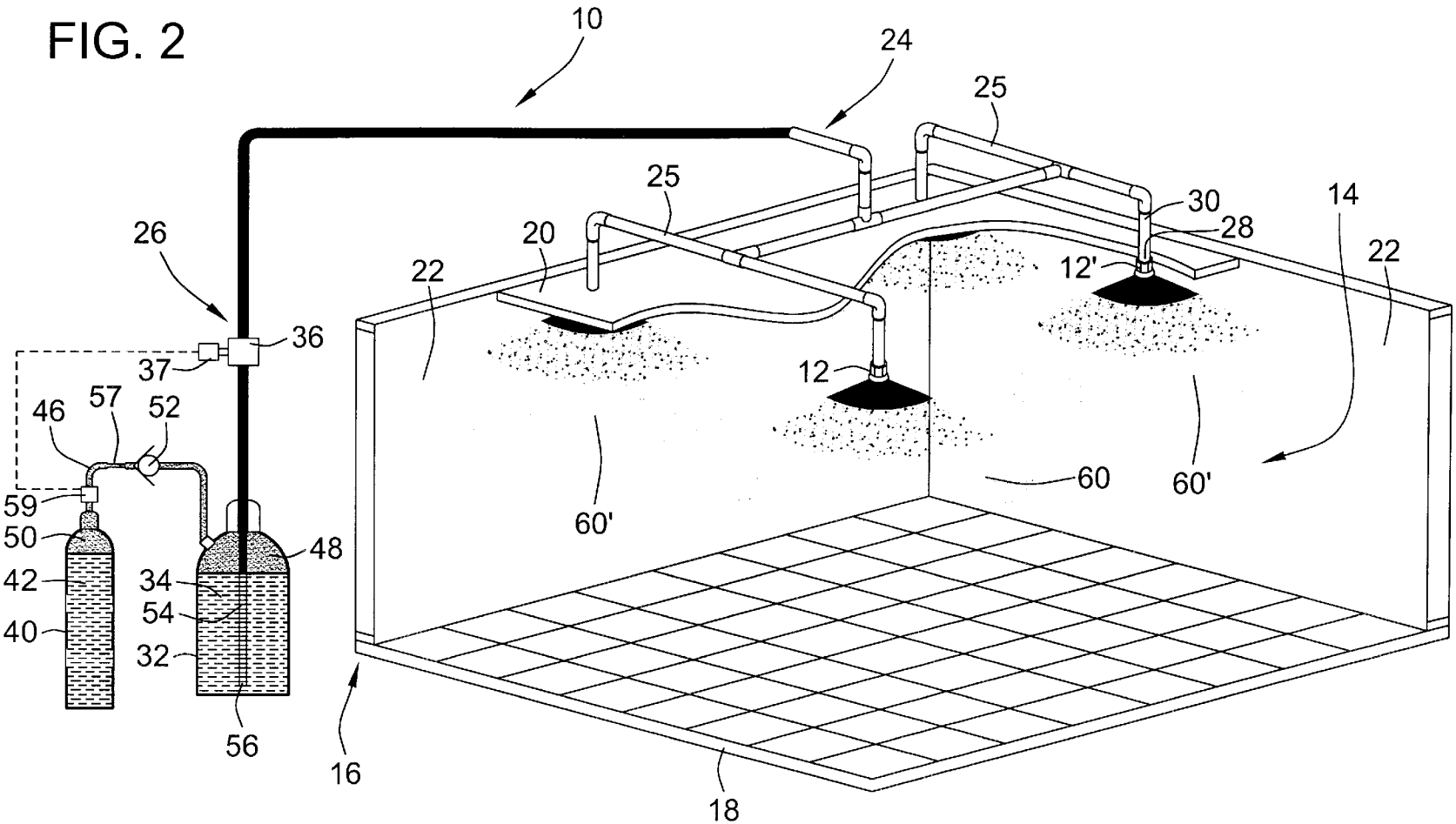
FIG. 2 is the same schematic illustration of FIG. 1, but with the fire suppression system in an active fire suppression mode.

For purposes of illustration, a preferred embodiment of the present invention is illustrated in FIG. 1 as a fixed clean agent fire suppression system 10 incorporating a plurality of atomizing nozzles 12, 12' for an enclosed area 14 of a building 16 or other similar structure (e.g. a large vessel, etc.). For purposes of orientation and reference, the building 16 includes a floor 18, a ceiling 20, and a plurality of walls 22 extending vertically between the floor and ceiling.

The system 10 generally includes a pipe network 24 of multiple interconnected pipes 25 for communicating volatile liquefied-gas fire suppressant (and in this case compress liquefied-gas fire suppressant) toward the enclosed area 14. The pipe network 24 may be an existing network previously used for a Halon 1301 system such that the disclosed fire suppression system is a retrofit system, or it may also be a new set of plumbing for a newly installed system. In either event, the pipe network 24 generally has an input end 26 for receiving clean agent and a plurality of outlet ports 28 for discharging clean agent into the enclosed area 14. In a typical system, the pipe network 24 generally extends throughout the ceiling 20 and/or the walls 22 of the building 16. In either event, the outlet ports 28 are typically provided by vertically downward extending branch pipes 30.

At the input end 26, the pipe network is connected to a tank or cylinder 32 of liquefied-gas fire suppressant 34 through a valve 36, two-way valve, or other suitable valve having open and closed states for selectively allowing or preventing flow. The valve 36 is actuated by a user control 37 or automatic control in response to a fire sensor, depending upon the system to allow the liquefied-gas fire suppressant 34 to flow through the pipe network 24. The gas fire suppressant 34 is stored in a liquefied state in the cylinder 32. Typically, the liquefied-gas fire suppressant will be stored at a low pressure of between 0.4 psig and 100 psig at room temperature, 25° C. In the disclosed embodiment, the gas fire suppressant 34 comprises at least one of the following liquefied-gases: 1,1,1,2,3,3,3-heptafluoropropane (HFC-227ea), and 1,1,1,3,3,3-hexafluoropropane (HFC-236fa). The more commonly used HFC-227ea has a boiling point of about −16.4° C. (2.5° F.) such that it normally assumes a gaseous state at room temperature, 25° C. Although two preferred suppressing agents are disclosed, it will be appreciated that the system is generally applicable to fire suppressants comprising at least one liquefied-gas selected from the following classes: hydrofluourocarbons, perfluorocarbons, hydroclorofluorocarbons, chemical variations of these which may include other atoms within the molecular structure such as oxygen or other suitable liquefied-gas that acts as a fire suppressant (including certain forms of halogenated ketones, aldehydes, alcohols, ethers, esters).

It is an aspect of the present invention that a piston flow system is used to push the gas fire suppressant 34 through the pipe network 24. In particular, a tank or cylinder 40 of a gas propellant 42 is arranged in fluid series with the clean agent cylinder 32. The propellant 42 may be a non-condensable gas, such as nitrogen or argon, or a liquefied compressed gas, such as carbon dioxide, which has a much lower boiling point than the fire suppressant 34 such that it provides a large pressure and propelling force for pushing the fire suppressant 34 through the pipe network 24. The gas propellant 42 is selected for fire safety and also to provide suitable propelling force by having a low boiling point. Suitable propellants for the system 10 include any of the following gases: carbon dioxide, nitrogen, argon, or any other suitable gas.

The compressed gas or liquefied compressed gas propellant 42 is stored separate from the liquefied fire suppressant 34. A connecting hose 46 connects the vapor area or gas zones 48, 50 above the liquid in the cylinders 32, 40. Preferably, no mixing of the vapor area gas zones 48, 50 is allowed by a on/off propellant valve 59 between the cylinders 40, 32 separating the propellant and clean agent. The propellant valve 59 may be the outlet valve of the propellant cylinder 40. In the alternative, some of the gas propellant 42 may also be allowed to enter the agent gas zone 48 in the clean agent cylinder 32 to maintain a high pressure load on the gas fire suppressant 34 in the compressed liquid state. A check valve 52 (which may also be a pressure relief valve) may also be arranged between the cylinders 32, 40. The check valve 52 is used to allow propellant 42 to enter the clean agent cylinder 32 while in an open state while preventing reverse flow while in the closed state. The piston flow systems is also arranged such that when the propellant valve 59 is open, only propellant in the gaseous state enters the clean agent cylinder 32. By only allowing gaseous propellant 42 to enter the cylinder 32, there is very little mixing or dissolving of propellant into the contained liquid of fire suppressant.

Upon the occurrence of a fire in the enclosed area 14, the on/off propellant valve 59 and the on/off system valve 36 are opened by the manual control 37 or an automated control in response to a sensor. These two valves 36, 59 may be linked such that the opening of one causes the other to open as well. According to one implementation, the propellant valve 59 is actuated to an open position releasing high pressure propellant. The on/off system valve 36 is connected to pressure downstream of the propellant valve 59 and actuated by this pressure.

Once the valves 36, 59 are opened, the propellant 42 pushes the fire suppressant 34 in a liquid state out of the agent cylinder 32 through a siphon tube 54 that has a fluid inlet 56 proximate the bottom of the cylinder 32. It will be appreciated to those skilled in the art that an alternative to the siphon tube 54 is to place the outlet port of the agent cylinder at or near the vertical bottom of the cylinder, again for the purposes of drawing the fire suppressant in liquid form. In either event, the fire suppressant 34 is delivered and pushed out of the agent cylinder 32 in a compressed liquid state into the pipe network 24. As the liquid volume in the agent cylinder 32 drops, more high pressure propellant 42 is drawn off of the liquid supply of the propellant cylinder 40 and enters the agent cylinder 32 in gaseous form through the check valve 52 and connecting hose 46. The propellant 42 maintains pressure on the fire suppressant 34 to push it out through the siphon tube 54 in the compressed liquid state until the agent cylinder 32 is empty. The rate of transfer of the propellant to the agent container is limited by a selectively sized flow restriction 57 located at the inlet of the check valve 52. The restriction 57 is selectively sized to provide a predetermined pressure to the clean agent and a predetermined flow rate of clean agent through the pipe network. The size of the restriction 57 is a variable that is selected and can be changed from system to system to meet the particular system requirements.

By preventing the propellant 42 from dissolving in the liquefied-gas fire suppressant 34, the fire suppressant 34 advantageously maintains a one phase liquid state when being pushed through the pipe network 24. The propellant 42 maintains a high enough pressure on the fire suppressant 34 to maintain the one phase liquid state despite a small pressure drop upon entering the pipe network 24. Virtually no propellant 42 dissolves into the liquefied-gas fire suppressant 34 being delivered through the pipe network 24. As such, vaporization of propellant 42 in the pipe network 24 is not a problem. This maintains a high mass flow rate of compressed liquefied-gas fire suppressant 34 through the pipe network because the volume of the pipe network 24 is occupied by a one phase high-density liquid instead of a two phase low-density liquid and gas combination.

While the disclosed embodiment achieves a high mass flow rate, there is no dissolved propellant in the liquefied-gas fire suppressant 34 to break the discharged fire suppressant 34 into small droplets for more rapid vaporization. The disclosed embodiment resolves this issue through another aspect of the invention, namely, a plurality of atomizing nozzles 12, 12' mounted to the outlet ports 28 of the pipe network 24. As shown in FIG. 1, the atomizing nozzles 12, 12' are arranged in spaced relation throughout the enclosed area 14. The atomizing nozzles 12, 12' work by spraying the discharged fire suppressant 34 still in liquid form radially outward into a thin liquid conical fan 60, 60'. The thin liquid conical fan 60, 60' rapidly vaporizes as a large surface area is developed due to the large surface area caused by thinning out the liquid and spraying the liquid radially outwardly. The thin liquid conical fan 60, 60' vaporizes quickly, thinning out to small droplets as it spreads radially outward.

Figure 3:
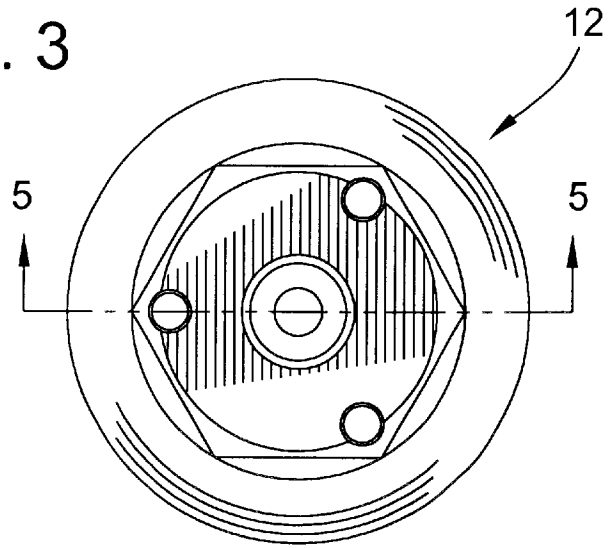
FIG. 3 is a top view of a 360° nozzle used in the system illustrated in FIG. 1.
Figure 4:
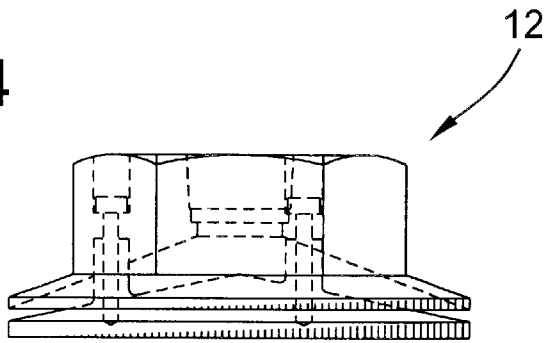
FIG. 4 is a side view of FIG. 3.
Figure 5:
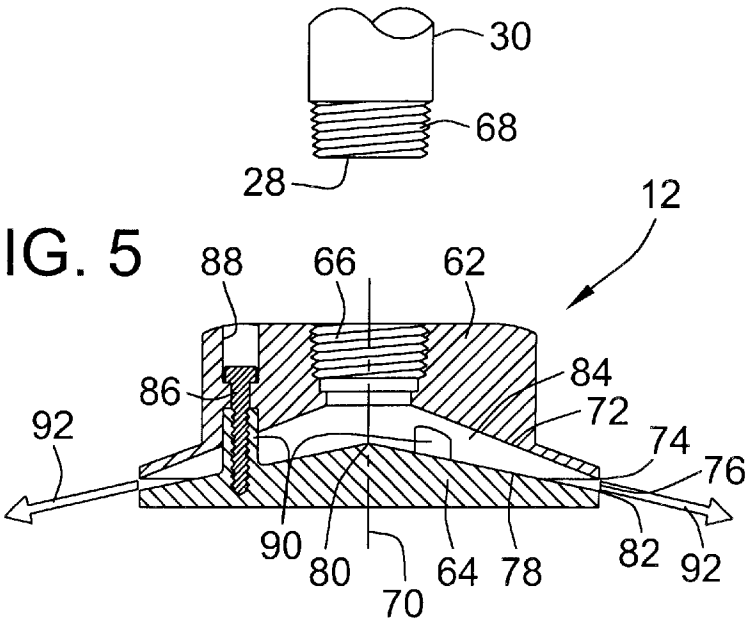
FIG. 5 is a cross section of FIG. 2 taken about line 5—5.

In the disclosed embodiment, and referring to the embodiment of FIGS. 3–5, each atomizing nozzle 12 comprises a nozzle body 62 and a deflector body 64. The nozzle body 62 includes a threaded inlet port 64 that mounts onto the threaded end 68 of the branch outlet pipes 30. The threads of the inlet port 64 may be configured to correspond to the threaded inlet ports of the removed single round orifice jet nozzles (not shown) used on prior Halon 1301 systems so that the nozzles 12 can replace the Halon nozzles to provide for a retrofit system. The inlet port 64 extends along nozzle axis 70 (also the vertical axis) until it intersects a conical flow surface 72 of the nozzle body 62. The conical flow surface 72 extends radially outward from the nozzle axis 70 to form a top annular edge 74 of a circumferential outlet slot 76. The deflector body 64 includes a conical deflector surface 78 in spaced relation to the conical flow surface 72 of the nozzle body 62. The deflector surface 78 extends radially outward from an apex 80 to a bottom annular edge 82 to define the circumferential outlet slot 76 in combination with the top annular edge 74. The nozzle body and deflector body surfaces 72, 78 define a conical flow passage 84 therebetween that extends radially outwardly and vertically downwardly to the circumferential outlet slot 76. The conical flow passage 84 converges radially outwardly toward the circumferential outlet slot 76 that extends at least part of the way around the axis 70. The nozzle body 62 and deflector body 64 may be secured together with screws 86 or any other fastener or other suitable securing device. In the disclosed embodiment, the screws 86 extend through counter-bore holes 88 in the nozzle body 62 and are fastened into axially projecting threaded bosses 90 that project into the holes 88. The bosses 90 and holes 88 are arranged at spaced angular positions about the axis 70 but preferably radially inward of the outlet slot 76.

The nozzles 12 atomize the fire suppressant by spraying the fire suppressant 34 out of the circumferential outlet slot 76 forming the thin liquid conical fan 60. Fire suppressant 34 enters the inlet port 66 axially is redirected radially outward through conical flow passage 84 where it is discharged and sprayed radially outward in the shape of a thin liquid conical fan 60 for vaporization.

A further aspect of the invention is that two different forms of nozzles 12, 12'. The first nozzle 12 shown is a 360° nozzle that sprays a thin liquid conical fan 60 all or substantially all of the way around the nozzle with a 360° conical fan 60 to quickly disperse the gas fire suppressant 34. The 360° nozzle 12 extends through the ceiling 20 and used away from the walls 22.

The second nozzle 12' shown is a 180° nozzle that sprays a thin liquid conical fan 60 about one half of the way around the nozzle with about a 180° conical fan 60 to prevent liquid interference of thin liquid conical fan 60 with the walls 22 while also quickly dispersing of the gas fire suppressant 34. The second nozzle 12' also extends through the ceiling 20 (or on elbow pipe joints projecting from the walls 22). However, in contrast to the 360° nozzles 12, the 180° nozzles 12' are instead used near the walls 22.

Figure 8:
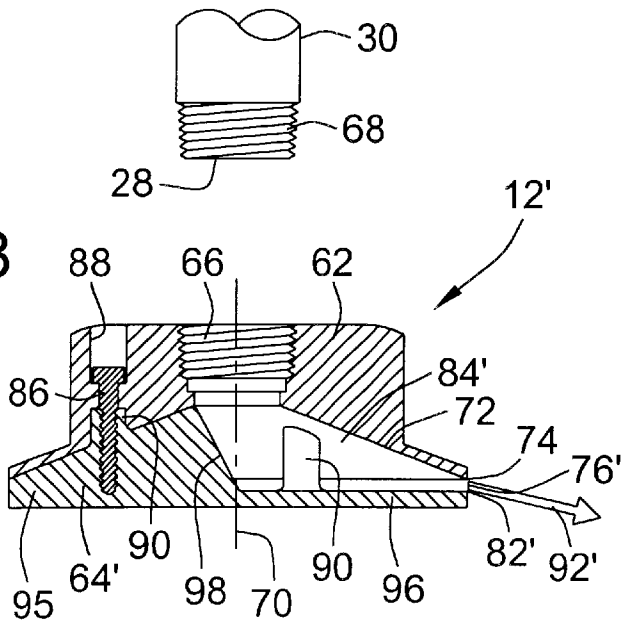
FIG. 8 is a cross section of FIG. 5 taken about line 8—8.
Figure 6:
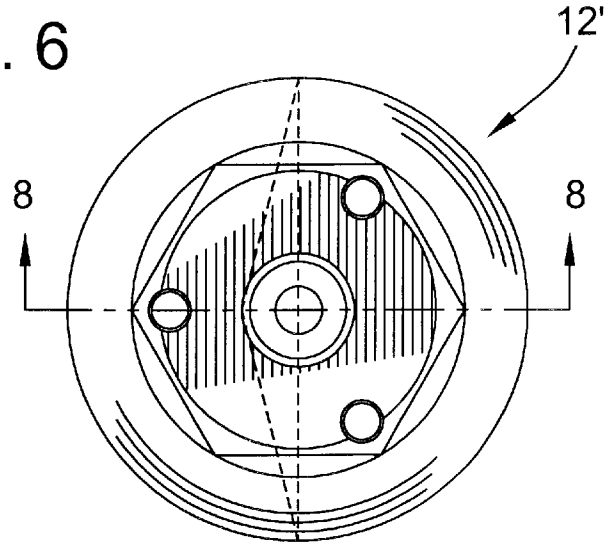
FIG. 6 is a top view of a 180° nozzle used in the system illustrated in FIG. 1.
Figure 7:
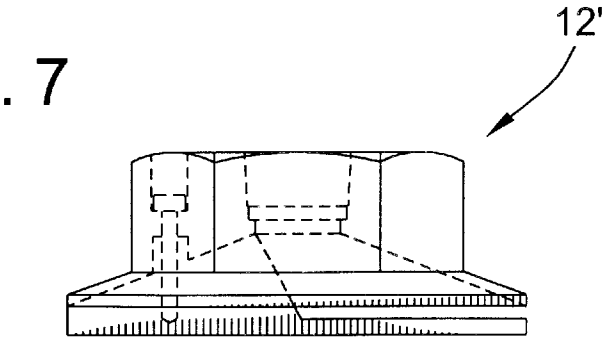
FIG. 7 is a side view of FIG. 6.
Figure 9:
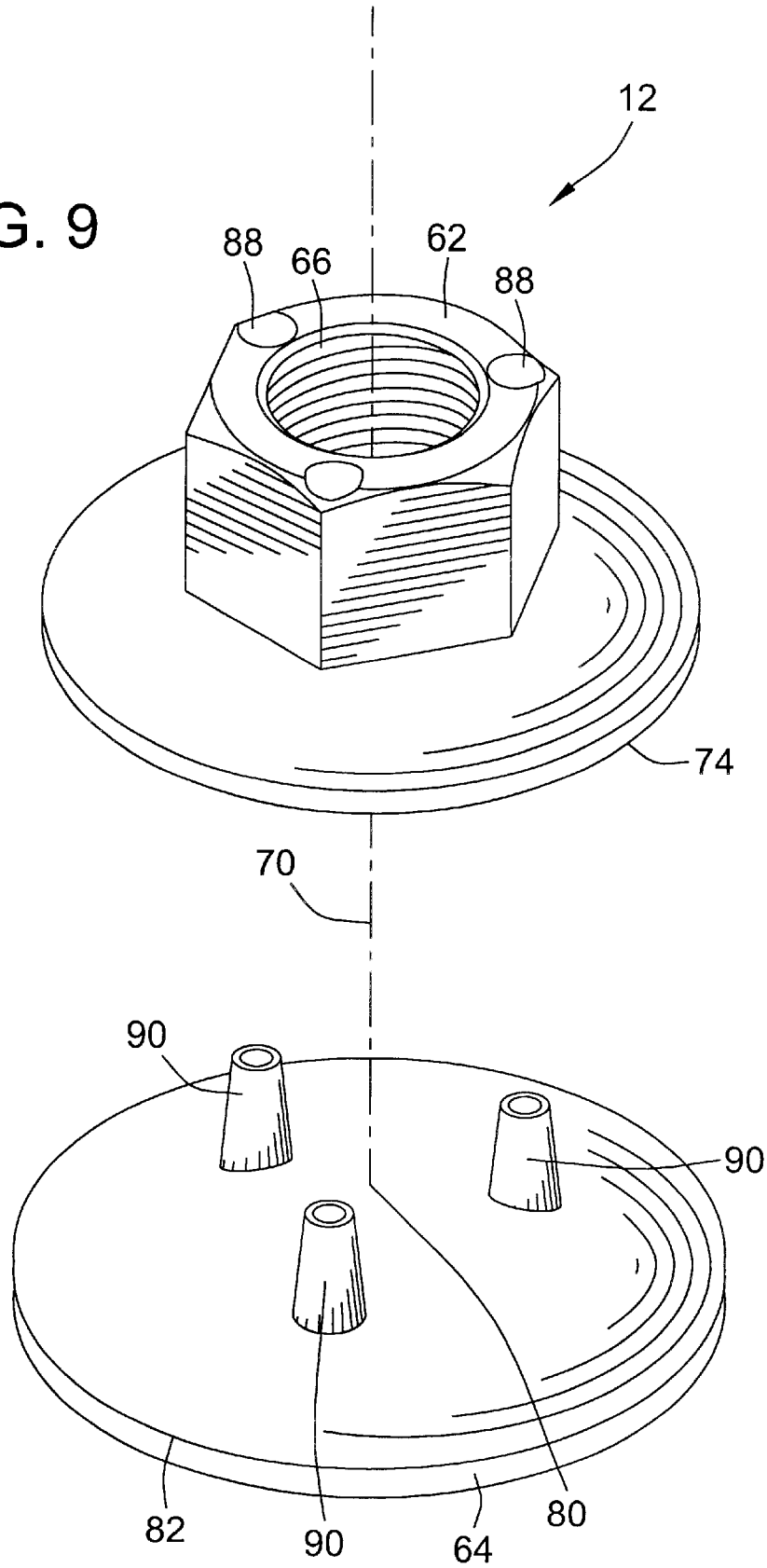
FIG. 9 is an exploded view of the 360° nozzle illustrated in FIG. 3.
Figure 10:
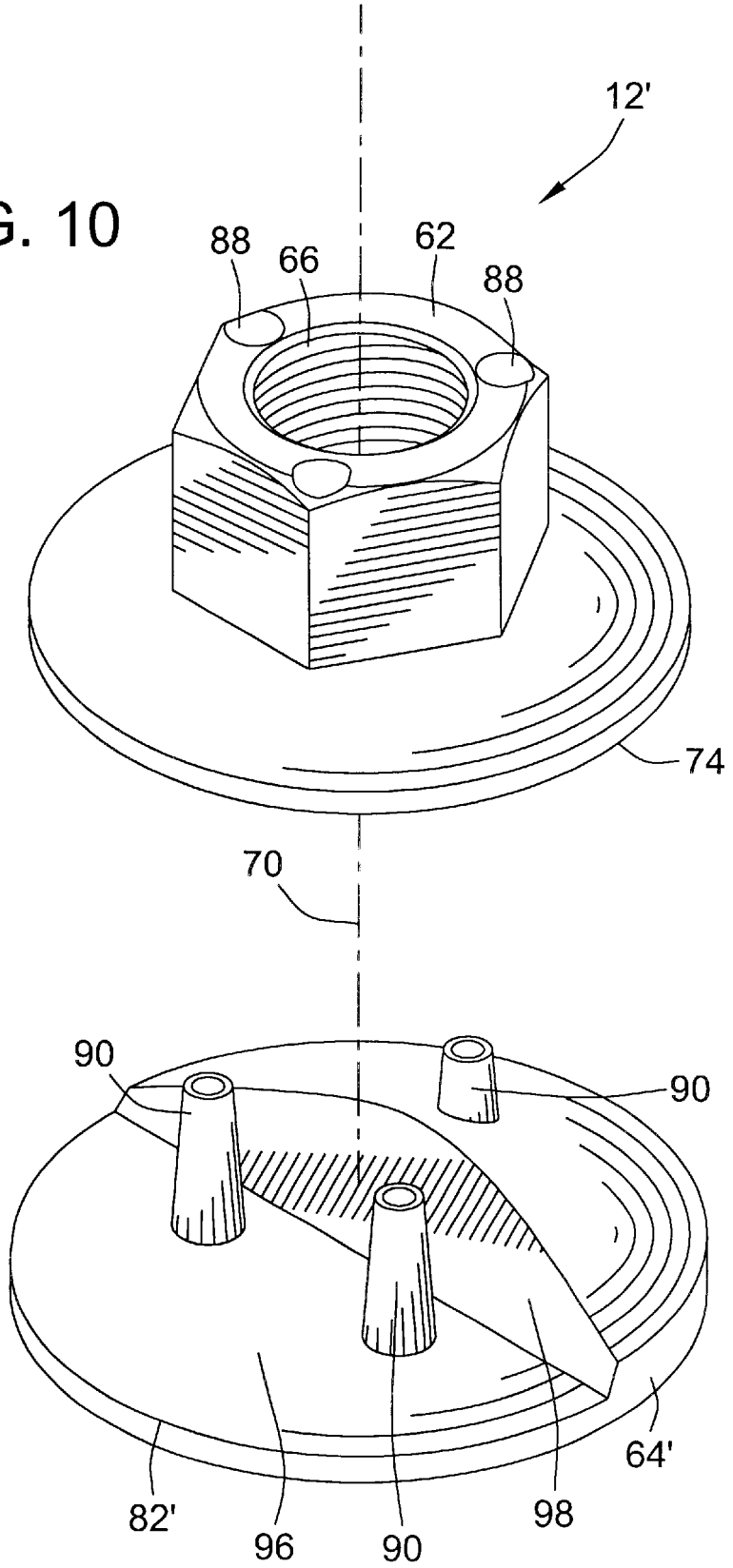
FIG. 10 is an exploded view of the 180° nozzle illustrated in FIG. 6.

As shown in FIGS. 6–8, the 180° nozzles 12' are substantially the same as the 360° nozzles 12 utilizing the same nozzle body 62. However, the 180° nozzles 12' include a different deflector body 64' that has a raised conical portion 95 on one half and a flat plate portion 96 on the other half joined by an angled portion 98. The raised conical portion 95 seats against the conical surface 72 of the nozzle body 62 preventing flow on one half of the nozzle 12'. The conical flow passage 84 extends from the inlet port 66 of the nozzle body 62 to the annular outlet slot 76' that extends about one half of the way around the nozzle 12'. Because the outlet slot 76' of the 180° nozzle 12' only extends one half of the way around the nozzle 12', the thickness of the outlet slot 76' is doubled as compared to the 360° nozzle 12 to provide for equal flow rates through each of the nozzles 12, 12'. This equalizes dispersion of fire suppressant material for retrofit systems where single stream jets near walls in Halon 1301 systems had the same flow rates for those single stream jets toward the room center.

There are certain desirable characteristics of either of the 360° and 180° nozzles 12, 12'. Preferably, the nozzles 12, 12' spray at a vertically downward trajectory 92, 92' of between about 45° and about 90° relative to the vertical nozzle axis 70 (the trajectory maybe the same or different for different nozzles). This range is preferable for preventing liquid interference with the ceiling 20 while at the same time minimizing the downward trajectory to increase the air contacting time for liquid fire suppressant 34, and therefore the ability of the suppressant 34 to completely vaporize to a gaseous state. The downward trajectories 92, 92' is also set at a sufficient downward angle to prevent interference with adjacent fans 60 sprayed by adjacent nozzles 12 if the nozzles 12 are spaced close together. The circumferential outlet slot 76, 76' also has an axial or vertical thickness of between about 0.030 inches and about 0.500 inches defined between the top outlet edge 74 and the bottom outlet edge 82, 82'. The slot 76, 76' is not so narrow as to be overly restrictive and is therefore wide enough to allow sufficient discharge rate and speed to adequately suppress a fire to meet or exceed requirements, which currently require delivery of the agent to the enclosed area 14 within ten seconds. The slot 76, 76' is also sufficiently narrow to keep the thin liquid conical fan 60, 60' sufficiently thin such that all or substantially all vaporization of fire suppressant 34 occurs before liquid contact with the floor 18 or other fixtures in the enclosed area 14. The axial thickness of the circumferential outlet slot 76, 76' is also preferably maintained uniform about the periphery of the nozzle 12, 12' to ensure that the liquid vaporizes in a consistent manner and to prevent the formation of multiple streams which could take longer to vaporize.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A fire suppression system for a structure, the structure including a floor, a ceiling, and a plurality of walls vertically between the floor and the ceiling, the system comprising:

a supply of a volatile liquefied-gas fire suppressant having a vapor pressure sufficient to form a gaseous mixture with air that does not support combustion for extinguishing fires;

a pipe network connected to the compressed liquefied-gas fire suppressant, the pipe network adapted to extend horizontally through at least one of the ceiling and walls of the structure, the pipe network including a plurality of outlet ports;

a plurality of atomizing nozzles mounted to the outlet ports, each of the atomizing nozzles comprising a nozzle body and a deflector body secured together in fixed relation, the nozzle body including an inlet port through the nozzle body connected to one of the outlet ports of the pipe network, a conical flow passage defined between the deflector body and nozzle body, the conical flow passage extending radially outwardly from the inlet port to a circumferential outlet slot, the circumferential outlet slot defined between the nozzle body and the deflector body and extending at least partially around the nozzle.

2. The fire suppression system of claim 1 wherein the deflector body includes a plurality of mounting bosses at spaced angular positions around the axis inserted into formed holes in the nozzle body, further comprising fasteners threaded into the bosses securing the nozzle body and deflector body together.

3. The fire suppression system of claim 1 wherein a first plurality of the atomizing nozzles are arranged proximate the walls and a second plurality of the atomizing nozzles are displaced away from the walls, the circumferential outlet slot of first plurality extending about on half of the way around the axis, the circumferential outlet slot of second plurality extending substantially all of the way around the axis.

4. The fire suppression system of claim 1 wherein the conical flow passage and circumferential outlet slot is configured to spray at a vertical downward trajectory angle of between about 45° and about 90° relative to the vertical axis.

5. The fire suppression system of claim 1 wherein the outlet slot has an axial thickness of between about 0.03 inches and about 0.50 inches.

6. The fire suppression system of claim 1 wherein the agent tank of the gas fire suppressant comprises at least one compressed gas from the following classes: hydrofluorocarbons, perfluorocarbons, hydraclorofluorocarbons, halogenated ketones, aldehydes, alcohols, ethers, and esters.

7. The fire suppression system of claim 6 wherein the agent tank of the gas fire suppressant comprises at least one of the following liquefied compressed gases: 1,1,1,2,3,3,3-heptafluoropropane, and 1,1,1,3,3,3-hexafluoropropane.

8. The fire suppression system of claim 7 wherein gas fire suppressant is stored at a low pressure of between 0.4 psig and 100 psig at room temperature, 25° C., further comprising means for pushing the gas fire suppressant through the pipe network and the atomizing nozzles.

9. The fire suppression system of claim 1 wherein the outlet slot is defined between parallel edges of the nozzle body and the deflector body, wherein the nozzle is adapted to spray a fan of liquid of a substantially uniform thickness.

10. The fire suppression system of claim 9 wherein the conical flow passage converges radially outwardly toward the parallel edges of the nozzle body and the deflector body.

11. A method of suppressing a fire in a structure, comprising:

storing a supply of a volatile liquefied-gas fire suppressant having a boiling point below room temperature, 25° C.;

receiving a demand to suppress the fire;

communicating the gas fire suppressant through a pipe network upon receipt of the demand to suppress the fire; and atomizing the gas fire suppressant communicated through the pipe network in the structure to vaporize the gas fire suppressant to a gaseous state, the atomizing step comprising spraying the gas fire suppressant in a liquid state radially outwardly relative to an axis in a thin liquid conical fan sufficiently thin such that the gas fire suppressant atomizes sufficiently to vaporize the sprayed gas fire suppressant to a gaseous state without substantial liquid contact with the structure.

12. The method of claim 11 further comprising initially deflecting the Thin liquid conical fun to a trajectory of between about 45° and about 90° relative to the axis.

13. The method of claim 11 further comprising constricting the thin liquid conical fan to between about 0.03 inches and about 0.50 inches.

14. The method of claim 11 wherein the thin liquid conical fan is constricted to a uniform thickness.

15. The method of claim 11 wherein the gas fire suppressant is sprayed radially outwardly all the way around the axis such that the thin liquid conical fan extends 360° around the axis.

16. The method of claim 11 wherein the gas fire suppressant is sprayed about one half the way around the axis such that the thin liquid conical fan extends about 180° around the axis.

17. The method of claim 11 wherein the structure includes a floor and a ceiling and a plurality of walls vertically between the floor and the ceiling, further comprising discharging the gas fire suppressant proximate the ceiling for atomization.

18. The method of claim 11 wherein the gas fire suppressant comprises at least one compressed gas from the following classes: hydrofluorocarbons, perfluorocarbons, hydroclorofluorocarbons, halogenated ketones, aldehydes, alcohols, ethers, and esters.

19. The fire suppression system of claim 18 where the gas fire suppressant comprises at least one of the following liquefied compressed gases: 1,1,1,2,3,3,3-heptafluoropropane, and 1,1,1,3,3.3-hexafluoropropane.

20. A fire suppression system for a structure, comprising:

an agent tank containing a gas fire suppressant in a liquefied state;

a propellant tank in fluid series with the agent tank, the propellant tank storing a gas propellant separate from the gas fire suppressant adapted to propel the gas fire suppressant;

a plurality of nozzles arranged in the structure in spaced relation;

a pipe network for communicating the gas fire suppressant to the nozzles; and a valve controlling fluid flow through the pipe network, the valve having an open state communicating the gas fire suppressant through the pipe network and a closed state preventing flow of the gas fire suppressant trough the pipe network;

wherein the nozzles comprise a nozzle body and a deflector body secured together in fixed relation, the nozzle body including an inlet port through the nozzle body along an axis and a conical flow surface extending radially outwardly from the inlet port, the deflector body including a conical deflector surface in spaced fixed relation to the conical flow surface wherein a conical flow passaee is defined between the conical flow surface and the conical deflector body surface, the conical flow passage extending radially outward to a circumferential outlet slot, the nozzles adapted to atomize the gas fire suppressant discharged from the circumferential outlet slot.

21. The fire suppression system of claim 20 wherein the conical deflector surface extends radially inwardly to form an apex coaxial with the inlet port.

22. The fire suppression system of claim 20 wherein the deflector body includes a plurality of mounting bosses at spaced angular positions around the axis inserted into formed holes in the nozzle body, further comprising fasteners threaded into the bosses securing the nozzle body and deflector body together.

23. The fire suppression system of claim 20 wherein the structure includes a floor, a ceiling, and a plurality of walls vertically between the floor and the ceiling, the nozzles being arranged in spaced locations across the ceiling with the conical flow surface and conical deflector surface angling downwardly toward the circumferential outlet slot, wherein a first plurality of the nozzles are arranged proximate the walls and a second plurality of the nozzles are displaced away from the walls, the circumferential outlet slot of first plurality extending about on half of the way around the axis, the circumferential outlet slot of second plurality extending substantially all of the way around the axis.

24. The fire suppression system of claim 20 wherein the agent tank contains at least one compressed liquefied-gas from the following classes: hydrofluorocarbons, perfluorocarbons, hydroclorofluorocarbons, halogenated ketones, aldehydes, alcohols, ethers, and esters.

25. The fire suppression system of claim 24 wherein the agent tank of the gas fire suppressant comprises at least one of the following liquefied compressed gases: 1,1,1,2,3,3,3-heptafluoropropane, and 1,1,1,3,3,3-hexafluoropropane.

26. The fire suppression system of claim 20 wherein the gas propellant is stored at a high pressure in excess of 300 psig at room temperature, 25° C.

27. The fire suppression system of claim 20 wherein the gas propellant produces a piston flow system when the valve is open with the gas propellant entering the agent tank to push the compressed liquefied-gas suppressant through the pipe network without substantial mixing of the gas propellant with the compressed liquefied-gas suppressant such that the compressed liquefied-gas suppressant is pushed through the pipe network in a substantially pure state and as a single phase liquid.

28. The fire suppression system of claim 27 further comprising a propellant valve in fluid series between the agent tank and the propellant tank, the propellant valve having a closed position preventing propellant from flowing into the agent tank and an open position permitting propellant to flow into the agent tank.

29. The fire suppression system of claim 28 wherein said valve is pressure responsive to the propellant valve.

30. The fire suppression system of claim 28 further comprising a check valve having a closed state preventing fluid flow from the agent tank to the propellant tank, the check valve having an open state for allowing gas propellant into the agent tank.

31. The fire suppression system of claim 27 further comprising restriction means in fluid series between the propellant tank and the agent tank for selectively setting a flow rate of gas fire suppressant in the liquefied state through the pipe network.

32. A fire suppression system for a structure, comprising:

an agent tank containing a gas fire suppressant in a liquefied state;

a propellant tank in fluid series with the agent tank, the propellant tank storing a gas propellant separate from the gas fire suppressant adapted to propel the gas fire suppressant;

a plurality of nozzles arranged in the structure in spaced relation;

a pipe network for communicating the gas fire suppressant to the nozzles; and a valve controlling fluid flow through the pipe network the valve having an open state communicating the gas fire suppressant through the pipe network and a closed state preventing flow of the gas fire suppressant through the pipe network;

wherein the structure includes a floor, a ceiling, and a plurality of walls vertically between the floor and the ceiling, the nozzles being arranged in spaced locations on the ceiling, and wherein the nozzles include an circumferential outlet slot extending radially about a vertical axis.

33. The fire suppression system of claim 32 wherein the circumferential outlet slot is configured to spray at a vertical downward trajectory angle of between about 45° and about 90° relative to the vertical axis.

34. The fire suppression system of claim 33 wherein the propellant tank of gas propellant comprises at least one of the following compressed gases: carbon dioxide, nitrogen, argon.

35. A The fire suppression system of claim 32 wherein the outlet slot has a vertical thickness of between about 0.03 inches and about 0.50 inches.

36. The fire suppression system of claim 32 wherein the nozzles atomize the gas fire suppressant discharged in the liquefied state from the circumferential outlet slot when the valves are valve is open substantially without liquid contact of the gas fire suppressant with the walls, floor or ceiling.

37. A retrofit system for a Halon fire suppressant system including a pipe network previously employed for Halon fire suppressant, the pipe network having a pre-selected size configured to carry Halon fire suppressant at a predetermined flow rate, the retrofit system comprising:

an agent tank containing a gas fire suppressant in a liquefied state;

a propellant tank in fluid series with the agent tank, the propellant tank storing a gas propellant separate from the gas fire suppressant adapted to propel the gas fire suppressant;

a plurality of nozzles arranged in the structure in spaced relation, wherein the nozzles comprise a nozzle body and a deflector body secured together in fixed relation, the nozzle body including an inlet port through the nozzle body along an axis and a conical flow surface extending radially outwardly from the inlet port, the deflector body including a conical deflector surface in spaced fixed relation to the conical flow surface wherein a conical flow passage is defined between the conical flow surface and the conical deflector body surface, the conical flow passage extending radially outward to a circumferential outlet slot, the nozzles adapted to atomize the gas fire suppressant discharged from the circumferential outlet slot a valve controlling fluid flow through the pipe network, the valve having an open state communicating the gas fire suppressant through the pipe network and a closed state preventing flow of the gas fire suppressant through the pine network;

wherein the gas propellant produces a piston flow system when the valve is open with the gas propellant entering the agent tank to push the compressed liquefied-gas suppressant through the pipe network without substantial mixing of the gas propellant with the compressed liquefied-gas suppressant such that the compressed liquefied-gas suppressant is pushed through the pipe network in a substantially mire state and as a single phase liquid;

the piston flow system delivering the compressed liquefied-gas suppressant substantially equal to the predetermined flow rate.

38. A method of suppressing a fire in a structure, comprising:

storing a first supply of a gas fire suppressant in a liquefied state;

storing a second supply of gas propellant in a compressed state separate from the first supply and in series with the first supply;

receiving a demand to suppress the fire;

charging the first supply of the gas fire suppressant with the propellant;

communicating the gas fire suppressant through a pipe network upon receipt of a demand to suppress the fire; and atomizing the gas fire suppressant communicated through the pipe network in the structure to cause the gas fire suppressant to assume a gaseous state;

wherein the step of atomizing comprises spraying the gas fire suppressant in a liquid state radially outwardly relative to an axis in a thin liquid conical fan sufficiently chin such that the gas fire suppressant atomizes sufficiently to vaporize the sprayed gas fire suppressant to a gaseous state without substantial liquid contact with the structure.

39. The method of claim 38 further comprising initially deflecting the thin liquid conical trajectory of between about 45° and about 90° relative to the axis.

40. The method of claim 39 further comprising constricting the thin liquid conical fan to between about 0.03 inches and about 0.50 inches.

41. The method of claim 38 wherein the gas fire suppressant is sprayed radially outwardly all the way around the axis such that the thin liquid conical fan extends 360° around the axis.

42. The method of claim 38 wherein the gas fire suppressant is sprayed about one half the way around the axis such that the thin liquid conical fan extends about 180° around the axis.

43. The method of claim 38 wherein the structure includes a floor and a ceiling and a plurality of walls vertically between the floor and the ceiling, further comprising discharging the gas fire suppressant from the ceiling for atomization.

44. The method of claim 38 wherein the gas fire suppressant is charged to a pressure of between 100 psig and 600 psig by the gas propellant.

45. The method of claim 38 further comprising pushing the gas fire suppressant with the gas propellant through the pipe network while substantially preventing gas propellant from being mixed with the gas fire suppressant such that the gas fire suppressant maintains a substantially complete liquid state while being communicated through the pipe network.

46. The method of claim 38 further comprising controlling flow between the first and second supplies with a propellant valve, the propellant valve having an open state for pressurizing the gas fire suppressant in the liquefied state and a closed position for preventing mixing of the first and second supplies.

47. The method of claim 38 further comprising selectively controlling the flow rate of gas fire suppressant through the pipe network with a restriction between the first and second supplies.

48. A method of retrofitting a fixed clean agent lire suppression system in a structure, the structure including a ceiling, a floor and a plurality of walls extending vertically between the floor and the ceiling, the fire suppression system comprising a pipe network for delivering a clean agent fire suppressant, the pipe network including an input end adapted to receive clean agent material and an output end comprising a plurality of outlet ports adapted to deliver clean agent material into the structure, the method comprising:

connecting a supply of a gas fire suppressant to the input end but keeping the gas fire suppressant from flowing through the pipe network until a demand to suppress a fire exists, the gas fire suppressant being in a liquefied state;

arranging a supply of gas propellant in series with the supply of the gas fire suppressant; separating the gas fire suppressant and the gas propellant with a valve having a closed state, the valve having an open state to allow gas propellant to charge the gas fire suppressant;

mounting a plurality of atomizing nozzles to the outlet ports of the pipe network selecting a configuration of each atomizing nozzle to comprise a nozzle body and a deflector body secured together in fixed relation, the nozzle body including an inlet port through the nozzle body connected to one of the outlet ports of the pipe network, a conical flow passage defined between the deflector body and nozzle body, the conical flow passage extending radially outwardly from the inlet port to a circumferential outlet slot the circumferential outlet slot defined between the nozzle body aid the deflector body and extending at least partially around the nozzle.

49. The method of claim 48 further comprising selecting a configuration of the atomizing nozzle to include a vertical downward trajectory angle of between about 45° and about 90°, and a size of the outlet slot with a vertical thickness of between about 0.03 inches and about 0.50 inches.

50. The method of claim 48, further comprising:

arranging a first plurality of the nozzles in close proximity to the walls, the circumferential outlet slot of the first plurality extending about one half the way around the nozzle; and arranging a second plurality of the nozzles away from the walls, the circumferential outlet slot of the first plurality extending substantially all of the way around the nozzle.

51. The method of claim 48 selecting a gas fire suppressant from at least one class comprising the following classes: hydrofluorocarbons, perfluorocarbons, and hydroclorofluorocarbons, halogenated ketones, aldehydes, alcohols, ethers, and esters.

52. The method of claim 51 comprising selecting the gas fire suppressant from at least one of the following liquefied compressed gases: 1,1,1,2,3,3,3-heptafluoropropane, and 1,1,1,3,3,3-hexafluoropropane.

53. A method of retrofitting a fixed clean agent fire suppression system in a structure, the structure including a ceiling, a floor and a plurality of walls extending vertically between the floor and the ceiling, the fire suppression system comprising a pipe network extending through the ceiling for delivering a clean agent fire suppressant, the pipe network including an input end connected to a supply of compressed liquefied-gas fire suppressant and an output end comprising a plurality of outlet ports adapted to deliver clean agent material into the structure, the method comprising:

mounting a plurality of atomizing nozzles to the outlet ports of the pipe network, each atomizing nozzle comprising a nozzle body and a deflector body secured together in fixed relation, the nozzle body including an inlet port through the nozzle body connected to one of the outlet ports of the pipe network, a conical flow passage defined between the deflector body and nozzle body, the conical flow passage extending radially outwardly from the inlet port to a circumferential outlet slot, the circumferential outlet slot defined between the nozzle body and the deflector body and extending at least partially around the nozzle.

54. The method of claim 53 further comprising:

arranging a first plurality of the nozzles in close proximity to the walls, the circumferential outlet slot of the first plurality extending about one half the way around the nozzle; and arranging a second plurality of the nozzles away from the walls, the circumferential outlet slot of the first plurality extending substantially all of the way around the nozzle.

55. The method of claim 53 further comprising selecting a configuration of the atomizing nozzle to include a vertical downward trajectory angle of between about 45° and about 90°, and a size of the outlet slot with a vertical thickness of between about 0.03 inches and about 0.50 inches.

56. A fire suppression system for a structure, the structure including floor, a ceiling, and a plurality of walls vertically between the floor and the ceiling, the lire suppression system comprising:

an agent tank containing a gas fire suppressant in a compressed liquefied state;

a propellant tank in fluid series with the agent tank, the propellant tank storing a gas propellant separate from the gas fire suppressant adapted to propel the gas fire suppressant;

a propellant valve controlling fluid flow between the agent tank and the propellant tank, the propellant valve having an open state communicating gas propellant into the agent tank and a closed state preventing fluid communication between the agent tank and the propellant tank;

a plurality of nozzles arranged in the structure in spaced relation across the ceiling, wherein the nozzles comprise a nozzle body and a deflector body secured together in fixed relation, the nozzle body including an inlet port through the nozzle body along an axis and a conical flow surface extending radially outwardly from the inlet port, the deflector body including a conical deflector surface in spaced fixed relation to the conical flow surface wherein a conical flow passage is defined between the conical flow surface and the conical deflector body surface, the conical flow passage extending radially outward to a circumferential outlet slot, the nozzles adapted to atomize the gas fire suppressant discharged from the circumferential outlet slot;

a pipe network extending through the ceiling connecting the agent tank to the inlet parts of the nozzles; and a system valve controlling fluid flow through the pipe network, the system valve having an open state communicating the gas fire suppressant through the pipe network and a closed state preventing flow of the gas fire suppressant through the pipe network.

57. The fire suppression system of claim 56 wherein a first plurality of the nozzles are arranged proximate the walls and a second plurality of the nozzles are displaced away from the walls, the circumferential outlet slot of first plurality extending about on half of the way around the axis, the circumferential outlet slot of second plurality extending substantially all of the way around the axis.

58. The fire suppression system of claim 56 wherein the circumferential outlet slot is configured to spray at a vertical downward trajectory angle of between about 45° and about 90° relative to the vertical axis, wherein the outlet slot has a vertical thickness of between about 0.03 inches and about 0.50 inches, wherein the outlet slot is defined between parallel edges of the nozzle body and the deflector body such that the nozzle is adapted to spray a fan of liquid of a substantially uniform thickness, and wherein the conical flow passage converges radially outwardly toward the parallel edges of the nozzle body and the deflector body.

59. The fire suppression system of claim 56 wherein the propellant tank of gas propellant comprises at least one of the following compressed gases: carbon dioxide, nitrogen, and argon; and wherein the agent tank of the contains at least one compressed liquefied-gas from the following classes: hydrofluorocarbons, perfluorocarbons, hydroclorofluorocarbons, halogenated ketones, aldehydes, alcohols, ethers, and esters.

60. The fire suppression system of claim 59 wherein the agent tank of the gas fire suppressant comprises at least one of the following liquefied compressed gases: 1,1,1,2,3,3,3-heptafluoropropalie, and 1,1,1,3,3,3-hexafluoroprop&ie.

61. The fire suppression system of claim 56 further comprising a check valve in series with the propellant valve arranged to prevent gas fire suppressant from flowing to the propellant tank.

62. The fire suppression system of claim 61 further comprising restriction means in fluid series with the propellant valve for selectively setting a flow rate of gas fire suppressant in the compressed liquefied state through the pipe network.

* * * * *